US009956798B2

(12) United States Patent
Sakano et al.

(10) Patent No.: US 9,956,798 B2
(45) Date of Patent: May 1, 2018

(54) TAPE PRINTING DEVICE AND TAPE PRINTING SYSTEM

(71) Applicant: Seiko Epson Corporation, Tokyo (JP)

(72) Inventors: Hideki Sakano, Matsumoto (JP); Akihiro Shintani, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/128,223

(22) PCT Filed: Mar. 19, 2015

(86) PCT No.: PCT/JP2015/001547

§ 371 (c)(1),
(2) Date: Sep. 22, 2016

(87) PCT Pub. No.: WO2015/146093

PCT Pub. Date: Oct. 1, 2015

(65) Prior Publication Data

US 2017/0210151 A1 Jul. 27, 2017

(30) Foreign Application Priority Data

Mar. 24, 2014 (JP) ..... 2014-060915
Mar. 24, 2014 (JP) ..... 2014-060922
Feb. 17, 2015 (JP) ..... 2015-028977

(51) Int. Cl.
*B41J 15/04* (2006.01)
*B41J 32/00* (2006.01)

(52) U.S. Cl.
CPC ..... *B41J 15/044* (2013.01); *B41J 32/00* (2013.01)

(58) Field of Classification Search
CPC ..... B41J 15/044; B41J 32/00
See application file for complete search history.

(56) References Cited

U.S. PATENT DOCUMENTS 4,620,199 A 10/1986 Tatsumi et al.
5,253,334 A 10/1993 Kimura et al.
(Continued)

FOREIGN PATENT DOCUMENTS

CN 101758676 A 6/2010
CN 102481794 A 5/2012
(Continued)

OTHER PUBLICATIONS

Machine Translation of JP 2013059918 A, Yamaguchi, Terushiro, "Tape Cassette and Printed Label-Making System", Apr. 4, 2013, Paragraphs 0029, 0045-0055, Figs. 1-6.*
(Continued)

*Primary Examiner* — Lisa M Solomon
(74) *Attorney, Agent, or Firm* — ALG Intellectual Property, LLC

(57) ABSTRACT

A tape printing device or the like in which the loading of a tape cartridge can be detected and in which the misalignment of the loaded tape cartridge can be restrained at the same time, is provided. A tape printing device includes: a cartridge loading section in which a tape cartridge is loaded in an unloadable manner; a push switch which is provided in the cartridge loading section and detects the loaded tape cartridge. The push switch has a stem which is energized in a protruding direction by a build-in spring, and the stem in an actuated state energizes the loaded tape cartridge in a direction intersecting with a loading direction.

12 Claims, 11 Drawing Sheets

(56) References Cited

U.S. PATENT DOCUMENTS

| | | | |
|---|---|---|---|
| 5,595,447 | A | 1/1997 | Takayama et al. |
| 5,666,251 | A | 9/1997 | Fujii et al. |
| 5,788,387 | A | 8/1998 | Takayama et al. |
| 6,126,344 | A | 10/2000 | Takayama et al. |
| 6,386,774 | B1 | 5/2002 | Takayama et al. |
| 2010/0166475 | A1 | 7/2010 | Yamaguchi et al. |
| 2010/0166477 | A1 | 7/2010 | Yamaguchi et al. |
| 2010/0166478 | A1 | 7/2010 | Yamaguchi et al. |
| 2010/0166479 | A1 | 7/2010 | Yamaguchi et al. |
| 2010/0166480 | A1 | 7/2010 | Yamaguchi et al. |
| 2010/0247205 | A1 | 9/2010 | Yamaguchi et al. |
| 2010/0247206 | A1 | 9/2010 | Yamaguchi et al. |
| 2010/0254742 | A1 | 10/2010 | Yamaguchi et al. |
| 2011/0103871 | A1 | 5/2011 | Van Coppenolle et al. |
| 2012/0080550 | A1 | 4/2012 | Yamaguchi et al. |
| 2012/0175454 | A1 | 7/2012 | Noda |
| 2013/0142560 | A1 | 6/2013 | Yamaguchi et al. |
| 2013/0315644 | A1 | 11/2013 | Yamaguchi et al. |
| 2014/0112694 | A1 | 4/2014 | Yamaguchi et al. |
| 2014/0175204 | A1 | 6/2014 | Yamaguchi et al. |
| 2014/0199108 | A1 | 7/2014 | Yamaguchi et al. |
| 2014/0204170 | A1 | 7/2014 | Yamaguchi et al. |
| 2014/0205341 | A1 | 7/2014 | Yamaguchi et al. |
| 2014/0205342 | A1 | 7/2014 | Yamaguchi et al. |
| 2014/0205343 | A1 | 7/2014 | Yamaguchi et al. |
| 2014/0205344 | A1 | 7/2014 | Yamaguchi et al. |
| 2014/0205345 | A1 | 7/2014 | Yamaguchi et al. |
| 2014/0205346 | A1 | 7/2014 | Yamaguchi et al. |
| 2014/0205347 | A1 | 7/2014 | Yamaguchi et al. |
| 2014/0205348 | A1 | 7/2014 | Yamaguchi et al. |
| 2014/0205349 | A1 | 7/2014 | Yamaguchi et al. |
| 2014/0205350 | A1 | 7/2014 | Yamaguchi et al. |
| 2014/0205352 | A1 | 7/2014 | Yamaguchi et al. |
| 2014/0205353 | A1 | 7/2014 | Yamaguchi et al. |
| 2014/0320581 | A1 | 10/2014 | Yamaguchi et al. |
| 2014/0340463 | A1 | 11/2014 | Van Coppenolle et al. |
| 2015/0174932 | A1 | 6/2015 | Yamaguchi et al. |
| 2015/0298476 | A1 | 10/2015 | Yamaguchi et al. |
| 2015/0306892 | A1 | 10/2015 | Noda |
| 2016/0250873 | A1 | 9/2016 | Van Coppenolle et al. |
| 2017/0008318 | A1 | 1/2017 | Yamaguchi et al. |

FOREIGN PATENT DOCUMENTS

| | | | |
|---|---|---|---|
| JP | H05-018853 | U | 3/1993 |
| JP | H06-349237 | A | 12/1994 |
| JP | 10-157235 | A | 6/1998 |
| JP | 2007-223292 | A | 9/2007 |
| JP | 2010-076167 | A | 4/2010 |
| JP | 2010-149434 | A | 7/2010 |
| JP | 2010-149437 | A | 7/2010 |
| JP | 2011-520645 | A | 7/2011 |
| JP | 2012-061862 | A | 3/2012 |
| JP | 2013-059918 | A | 4/2013 |
| JP | 2013-141749 | A | 7/2013 |
| WO | WO2013-039139 | A | 3/2013 |

OTHER PUBLICATIONS

Search Report received in International Application No. PCT/JP2015/001547, dated Jun. 16, 2015.

* cited by examiner

| | FIRST DETECTION SWITCH 65A | SECOND DETECTION SWITCH 65B | THIRD DETECTION SWITCH 65C |
|---|---|---|---|
| TAPE CARTRIDGE 100A | ON | OFF | OFF |
| TAPE CARTRIDGE 100B | ON | ON | OFF |
| TAPE CARTRIDGE 100C | ON | ON | ON |
| NOT LOADED | OFF | OFF | OFF |

TAPE PRINTING DEVICE AND TAPE PRINTING SYSTEM

CROSS-REFERENCE TO RELATED APPLICATIONS

This application is the U.S. National Phase under 35 U.S.C. § 371 of International Application No. PCT/JP2015/001547 filed on Mar. 19, 2015, which in turn claims the benefit of Japanese Application No. 2014-060915 filed on Mar. 24, 2014, Japanese Application No. 2014-060922 filed on Mar. 24, 2014, and Japanese Application No. 2015-028977 filed on Feb. 17, 2015, the disclosures of which are expressly incorporated by reference herein.

TECHNICAL FIELD

The present invention relates to a tape printing device and a tape printing system in which a push switch for detecting a tape cartridge is provided in a cartridge loading section.

BACKGROUND ART

According to the related art, as a tape cartridge of this type, a tape cassette having a recessed space corresponding to a sensor support portion provided in a cassette loading section of a print label preparation device is known (see JP-2013-141749).

In the cassette loading section of the print label preparation device, a print mechanism and a feed mechanism for performing printing on a tape drawn out of the tape cassette are arranged. Also, in the cassette loading section, rectangular column-like sensor support portion with a plurality of sensors incorporated therein for detecting attribute information of the tape (film tape) is provided upright. The sensor support portion is provided with four reflection-type sensors vertically arrayed on the front side and four reflection-type sensor similarly vertically arrayed on the right lateral side.

Meanwhile, the tape cassette includes an adhesive tape spool with a double-sided adhesive tape wound thereon, a film tape spool with a film tape (print tape) wound thereon, a ribbon spool with an ink ribbon wound thereon, a ribbon take-up spool for taking up the ink ribbon, a tape drive roller, and a cassette case accommodating these. Also, a recessed space corresponding to the sensor support portion is formed in the space between the double-sided adhesive tape and the film tape. Moreover, a total of eight solid black sections to be detected corresponding to the above reflection-type sensors are provided in a peripheral wall portion forming the recessed space.

SUMMARY

In such a tape cassette according to the related art, since the recessed space is provided in the narrow space between the double-sided adhesive tape and the film tape, the sections to be detected must be formed compactly. Therefore, there is a risk that the information volume of the attribute information of the film tape to be a detection target might be limited or that its detection might become unstable.

Meanwhile, if, for example, the sections to be detected are provided on the bottom side of the tape cassette (tape cartridge) in order to secure a large space and the detection portions on the side of the cassette loading section are microswitches or the like, a force that causes the tape cassette to float up acts and therefore a structure to restrain this is required.

An object of the invention is to provide a tape printing device and a tape printing system in which the loading of a tape cartridge can be detected and in which the misalignment of the loaded trap cartridge can be restrained at the same time.

A tape printing device according to the invention includes: a cartridge loading section in which a tape cartridge is loaded in an unloadable manner; and a push switch which is provided in the cartridge loading section and detects the loaded tape cartridge. The push switch has a stem which is energized in a protruding direction by a build-in spring. The stem in an actuated state energizes the loaded tape cartridge in a direction intersecting with a loading direction.

According to this configuration, when a tape cartridge is loaded in the cartridge loading section, the stem is actuated and the tape cartridge can be detected by the push switch. Also, since the stem in the actuated state energizes the loaded tape cartridge in the direction intersecting with the loading direction, the tape cartridge can be prevented from floating up or the like and the misalignment of the tape cartridge can be restrained in the cartridge loading section.

In this case, it is preferable that the cartridge loading section includes a loading base portion and a loading peripheral wall portion surrounding the loading base portion, that the push switch is arranged on the loading peripheral wall portion, and that the stem energizes an outer circumferential surface of the tape cartridge facing the loading peripheral wall portion.

According to this configuration, since the stem energizes the outer circumferential surface of the tape cartridge, no special section to be detected that requires a space is needed on the tape cartridge side. Also, since the stem can directly energize the tape cartridge, the structure on the push switch side can be simplified.

In this case, it is preferable that the tape cartridge has a plurality of sections to be detected on the outer circumferential surface, and that the push switch is provided in a plural number corresponding to the plurality of sections to be detected.

In this case, it is preferable that the plurality of push switches is arranged in a dispersed manner in a circumferential direction of the loading peripheral wall portion, corresponding to the plurality of sections to be detected arranged in a dispersed manner in a circumferential direction.

According to these configurations, the plurality of push switches can be arranged without any problem in terms of space. Also, with the plurality of push switches, the misalignment of the tape cartridge can be restrained.

It is also preferable that, in the cartridge loading section, a plurality of types of the tape cartridges with different thicknesses in the loading direction is loadable, that the plurality of tape cartridges has the sections to be detected having different lengths from a distal end in the loading direction, corresponding to the thicknesses, and that the plurality of push switches is arranged in such a way as to have different distances from the loading base portion toward a direction opposite to the loading direction, corresponding to the sections to be detected in the plurality of types of tape cartridges.

According to this configuration, the sections to be detected in the plurality of types of tape cartridges and the plurality of push switches can be made to correspond to each other in a height direction. Therefore, not only the loading of the plurality of push switches but also the type corresponding to the thickness in the loading direction of the tape cartridge can be detected at the same time.

In this case, it is preferable that, of the plurality of push switches, the push switch with the shortest distance from a print head provided in the cartridge loading section is in an actuated state no matter which of the plurality of types of tape cartridge is loaded.

According to this configuration, even when a relatively thin tape cartridge is loaded, the misalignment of the tape cartridge can be restrained by the spring force of the push switch.

Meanwhile, it is preferable that the tape cartridge has an insertion opening in which a head cover covering a print head provided in the cartridge loading section is inserted, that the push switch is provided at an edge part of the head cover, and that the stem energizes a corner part of the insertion opening corresponding to the edge part.

According to this configuration, since the stem energizes the corner part of the insertion opening in the tape cartridge, no special section to be detected that requires a space is needed on the tape cartridge side. Also, since the push switch is arranged at the edge part of the head cover, the push switch can be arranged with high spatial efficiency.

In this case, it is preferable that the tape printing device includes a main body abutting portion provided in a protruding manner on the head cover, corresponding to a cartridge-side abutting portion provided in a recessed manner at the corner part of the insertion opening, that the main body abutting portion is provided on the head cover in a movable manner in a direction of fitting with the cartridge-side abutting portion, and that the stem energizes the cartridge-side abutting portion via the main body abutting portion.

In this case, it is preferable that the main body cutting portion is supported on the head cover in such a way as to be able to swivel about a swivel shaft.

According to these configurations, as the main body abutting portion energized by the stem is fitted with the cartridge-side abutting portion, the tape cartridge can be positioned on the head cover, that is, in the cartridge loading section.

It is also preferable that the tape printing device further includes a first output portion which is provided in the cartridge loading section and outputs a forward rotational force to feed the print tape of the loaded tape cartridge, and a second output portion which is provided in the cartridge loading section and outputs a reverse rotational force to feed the ink ribbon of the loaded tape cartridge, and that the main body abutting portion is arranged on or near an imaginary line connecting the first output portion and the second output portion.

In this case, it is preferable that the first output portion has a platen drive shaft which rotationally drives a platen roller of the tape cartridge feeding the print tape, and that the second output portion has a take-up drive shaft which rotationally drives a take-up core of the tape cartridge taking up the ink ribbon.

According to these configurations, a combination force made up of a moment of rotation received by the tape cartridge from the first output portion and a moment of rotation received by the tape cartridge from the second output portion has a maximum value on the imaginary line, and the main body abutting portion energized by the stem receives this force. That is, the forces received from the first output portion and the second output portion are absorbed by the stem. Therefore, the misalignment of the tape cartridge can be restrained efficiently.

A tape printing system according to the invention includes; the above tape printing device; and the tape cartridge loaded in the cartridge loading section in an unloadable manner.

According to this configuration, the loading of the tape cartridge can be detected and the misalignment of the loaded tape cartridge can be restrained at the same time. Therefore, high print quality can be maintained.

DESCRIPTION OF EXEMPLARY EMBODIMENTS

Hereinafter, a tape printing device and a tape printing system according to an embodiment of the invention will be described, referring to the accompanying drawings. This tape printing device is configured to perform printing while reeling off a print tape and an ink ribbon from a tape cartridge loaded therein, and cut a printed part of the print tape, thus preparing a label (tape piece). Also, the tape printing system is made up of this tape printing device and a tape cartridge loaded and used therein.

[Outline of Tape Printing Device]

Figure 1:
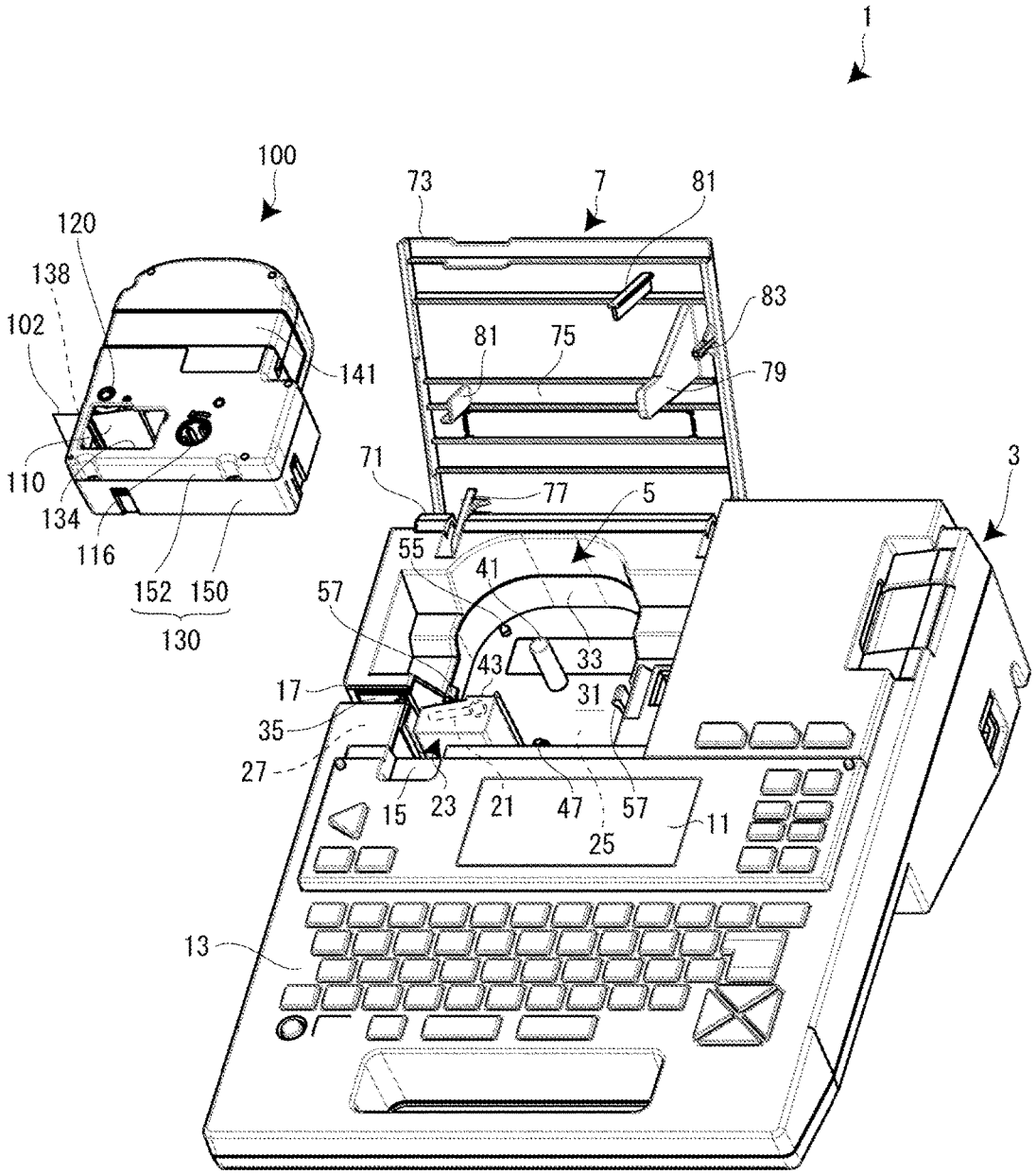
FIG. 1 is an external perspective view of an open-cover state of a tape printing device according to an embodiment.

FIG. 1 is an external perspective view of a tape printing device and a tape cartridge loaded therein. As shown in FIG. 1, a tape printing device 1 includes a device case 3 forming an outer shell, a cartridge loading section 5 in which a tape cartridge 100 is loaded in an unloadable manner, and an open/close cover 7 which opens and closes the cartridge loading section 5. On atop surface of the device case 3, the cartridge loading section 5 is provided on the rear side, a display 11 is provided in the center, and a keyboard 13 is provided on the forward side. A concave portion 15 to hook a finger is provided near the open/close cover 7. The open/close cover 7 is opened by having a finger hooked on this concave portion 15 and lifting up the open/close cover 7. Then, on a lateral side (left side) of the device case 3, a vertically long tape discharge port 17 through which a print tape 102 is discharged is provided.

Also, the tape printing device 1 includes a print mechanism section 23 having a print head 21 provided upright in the cartridge loading section 5, a tape feed mechanism section 25 provided inside the space on the back of the cartridge loading section 5, and a tape cutting mechanism section 27 provided inside near the tape discharge port 17. The user inputs print information from the keyboard 13, confirms the print information on the display 11, and subsequently executes printing by a key operation. As a print command is given, the tape feed mechanism section 25 is driven, thus causing the print tape 102 and an ink ribbon 110 to travel in parallel. Moreover, due to the heat applied to the ink ribbon 110 from the print mechanism section 23, the ink ribbon 110 is transferred to the print tape 102, thus carrying out printing based on thermal transfer. By this print feed, the print tape 102 is discharged from the tape discharge port 17. When the printing is completed, the tape cutting mechanism section 27 is driven, thus cutting the printed part of the print tape 102.

[Outline of Tape Cartridge]

As shown in FIGS. 2A and 2B, and FIGS. 5A and 5B, the tape cartridge 100 includes a tape roll 106 having the print tape 102 wound on a tape core 104. Also, the tape cartridge 100 includes a ribbon roll 114 having the ink ribbon 110 wound on a reel-off core 112, and a take-up core 116 which takes up the ink ribbon 110 after use. Also, the tape cartridge 100 includes a platen roller 120 (platen) against which the print head 21 abuts and which feeds the print tape 102 and the ink ribbon 110. Moreover, the tape cartridge 100 has a cartridge case 130 accommodating the tape roll 106, the ribbon roll 114, the take-up core 116, and the platen roller 120. In this way, the tape cartridge 100 in this embodiment has a so-called shell structure in which the outer shell is covered by the cartridge case 130.

Also, in the tape cartridge 100, an insertion opening 134 in which the print head 21 is inserted when the tape cartridge 100 is loaded in the tape printing device 1 is formed in the cartridge case 130. The tape cartridge 100 has a tape outlet port 138 which is formed in the cartridge case 130 and through which the print tape 102 is sent out. Also, as will be described in detail later, the tape roll 106 is rotatably supported on a cylindrical core shaft 192 provided in a protruding manner on the inside of the cartridge case 130.

As the platen roller 120 and the take-up core 116 are driven by the above tape feed mechanism section 25, the print tape 102 is reeled off from the tape core 104, and the ink ribbon 110 is reeled off from the reel-off core 112. The print tape 102 and the ink ribbon 110, thus reeled off, travel in parallel at the part of the platen roller 120 and are used for printing by the print head 21. The reel-off end (printed part) of the print tape 102 where printing has been done is sent out toward the tape discharge port 17 from the tape outlet port 138. Meanwhile, the ink ribbon 110 travels around a peripheral wall part of the insertion opening 134 and is taken upon the take-up core 116. As the tape cartridge 100, a plurality of types with different thicknesses (in the embodiment, three types) is prepared according to the tape widths of the print tape 102.

[Details of Tape Printing Device]

Figure 3:
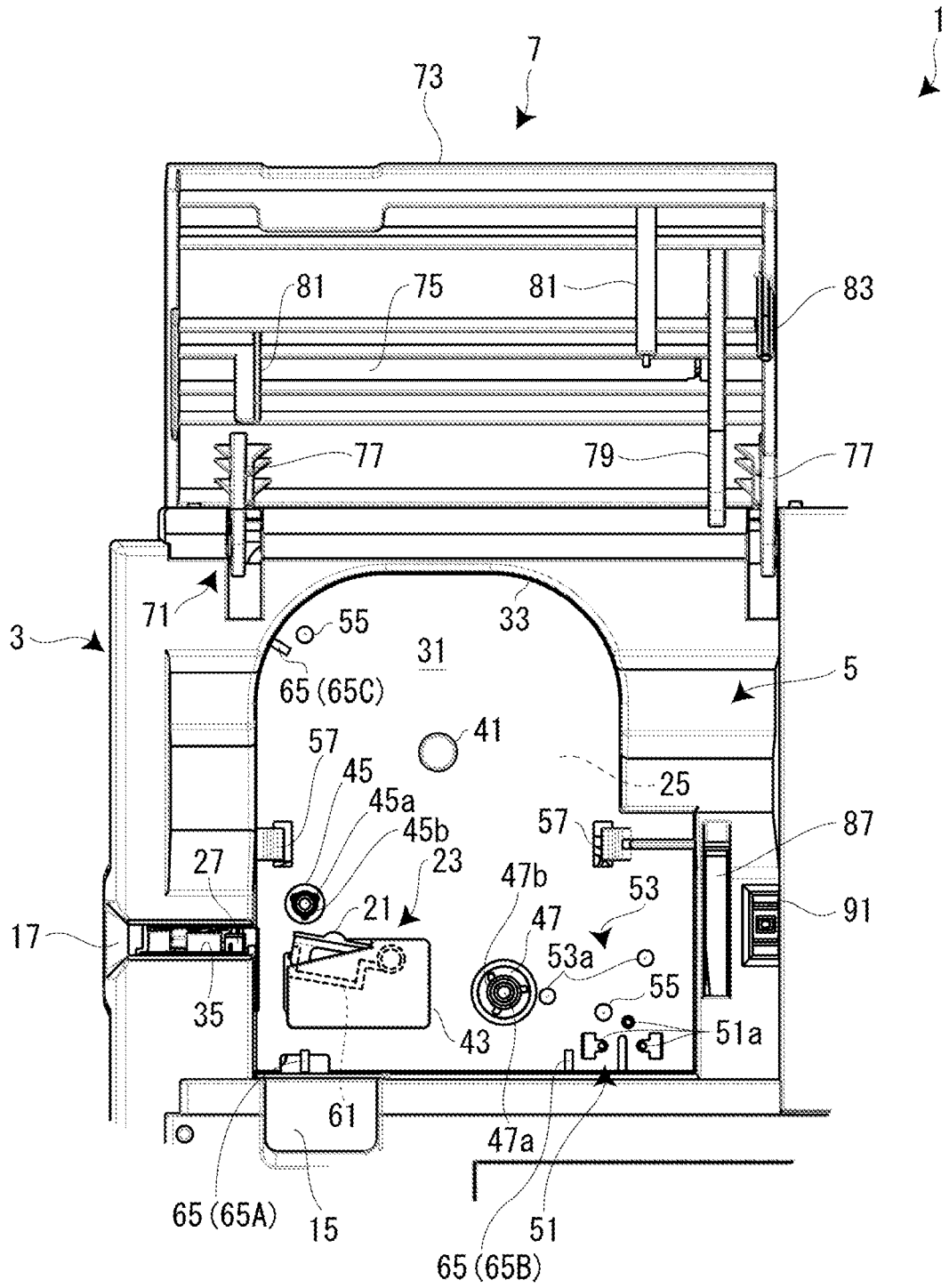
FIG. 3 is a top view of a cartridge loading section.

As shown in FIG. 1 and FIG. 3, the cartridge loading section 5 is formed in a shape complementary to the planar shape of the tape cartridge 100 and is concavely formed to a depth corresponding to the tape cartridge 100 with a maximum thickness, of the plurality of types of loadable tape cartridges 100. In this case, a loading base portion 31 forming a bottom plate part of the cartridge loading section 5, and a loading peripheral wall portion 33 forming a side plate part, are integrally formed (molded) of a resin or the like. A slit-like tape discharge path 35 is formed between the cartridge loading section 5 and the above tape discharge port 17, and the above tape cutting mechanism section 27 is arranged inside this part.

On the loading base portion 31 of the cartridge loading section 5, a positioning protrusion 41 with which the core shaft 192 of the tape cartridge 100 is fitted and positioned when the tape cartridge 100 is loaded is provided upright. Also, the print head 21 covered by a head cover 43, a platen drive shaft 45 which rotationally drives the platen roller 120, and a take-up drive shaft 47 which rotationally drives the take-up core 116 are provided upright on the loading base portion 31. Also, on the loading base portion 31, a tape detection section 51 which detects the type (attribute information) of the print tape 102, and a core release section 53 which cancels the rotation stopper of the reel-off core 112 and the take-up core 116 are provided near the take-up drive shaft 47.

Moreover, a pair of small protrusions 55 is provided at diagonal positions on the loading base portion 31, and in addition, a pair of hook pieces 57 which hooks a middle part of the loaded tape cartridge 100 is provided. Then, in the space on the back of the loading base portion 31, the above tape feed mechanism section 25 made up of a motor and a gear train (neither of them being illustrated) or the like for rotating the platen drive shaft 45 and the take-up drive shaft 47 is arranged inside. The tape feed mechanism section 25 performs power branching via the gear train and thus causes the platen drive shaft 45 and the take-up drive shaft 47 to rotate synchronously.

The print mechanism section 23 has the print head 21 made up of a thermal head, and a head support frame 61 which supports the print head 21 and causes the print head 21 to swivel. Also, the print mechanism section 23 has a head release mechanism (not illustrated) which causes the print head 21 to swivel between a printing position and a retreat position via the head support frame 61, and the head cover 43 covering the print head 21 (and the head support frame 61).

The head release mechanism is actuated, interlocked with the opening/closing of the above open/close cover 7, and causes the print head 21 to move (swivel) to the printing position, interlocked with the closing operation of the open/close cover 7. Also, the head release mechanism causes the print head 21 to move (swivel) to the retreat position, interlocked with the opening operation. The print head 21, having moved to the printing position, abuts against the platen roller 120 of the tape cartridge 100 via the ink ribbon 110 and the print tape 102. The print head 21, having moved to the retreat position, is spaced apart from the platen roller 120. Thus, the print tape 102 and the ink ribbon 110 are prevented from interfering with the print head 21 at the time of loading or unloading the tape cartridge 100.

A plurality of heat generating elements is provided in the print head 21, and the plurality of heat generating elements is arrayed in the same direction as the axial direction of the platen roller 120. Then, printing is carried out by feeding the print tape 102 and the ink ribbon 110 and selectively driving the plurality of heat generating elements.

The head cover 43 is formed in a substantially rectangular shape, as viewed in a plan view, and is integrally formed (molded) with the above loading base portion 31 (cartridge loading section 5). Also, the head cover 43 vertically largely protrudes from the loading base portion 31, allows the print head 21 to swivel inside the head cover 43, and functions on its outside as a loading guide for the tape cartridge 100.

The tape detection section 51 is made up of a plurality of microswitches 51*a*, is selectively engaged with a detection receiving section 178 of the tape cartridge 100, described later, and detects the type including the tape color, material and the like of the print tape 102. Then, on the basis of the result of the detection, the driving of the print head 21 and the tape feed mechanism section 25 is controlled. Also, the tape width of the print tape 102 is detected by a thickness detection switch 65, described later, as the thickness of the tape cartridge 100.

The core release section 53 is made up of two cancellation pins 53*a* for the reel-off core 112 and the take-up core 116. As will be described in detail later, rotation stopper hooks 206 to be hooked on the reel-off core 112 and the take-up core 116, respectively, are provided in the cartridge case 130 (see FIG. 6). As the tape cartridge 100 is loaded, the cancellation pins 53*a* are engaged with these rotation stopper hooks 206, cancelling the rotation stopper of the reel-off core 112 and the take-up core 116.

The platen drive shaft 45 has a fixed shaft 45*a* inserted through the platen roller 120, and a spline-shaped movable shaft 45*b* rotatably axially supported at a proximal part of the fixed shaft 45*a*. The rotational power of the tape feed mechanism section 25 is transmitted to this movable shaft 45*b* and further transmitted from the movable shaft 45*b* to the platen roller 120. Similarly, the take-up drive shaft 47 has a fixed shaft 47*a* and a spline-shaped movable shaft 47*b* rotatably axially supported on the fixed shaft 47*a*. In this case, too, the rotational power of the tape feed mechanism section 25 is transmitted to the movable shaft 47*b* and further transmitted from the movable shaft 47*b* to the take-up core 116.

When the tape cartridge 100 is loaded in the cartridge loading section 5, the core shaft 192 (tape core 104) is engaged with the positioning protrusion 41, and the platen roller 120 is engaged with the platen drive shaft 45. Moreover, the take-up core 116 is engaged with the take-up drive shaft 47. Then, as the open/close cover 7 is closed, the print head 21 swivels and abuts against the platen roller 120 with the print tape 102 and the ink ribbon 110 held in-between. Thus, the tape printing device 1 enters into a print standby state.

Meanwhile, as shown in FIG. 3, a plurality of thickness detection switches 65 for detecting the thickness of the loaded tape cartridge 100 is provided on the loading peripheral wall portion 33 of the cartridge loading section 5. As the tape cartridge 100 in the embodiment, for example, a relatively thin tape cartridge 100A with a 12-mm-wide print tape 102 loaded therein, a medium-thickness tape cartridge 100B with an 18-mm-wide print tape 102 loaded therein, and a relatively thick tape cartridge 100C with a 24-mm-wide print tape 102 loaded therein, are prepared (see FIGS. 10A and 10B). The width of the print tape 102 is the length of the print tape 102 in the direction intersecting with the direction in which the print tape 102 is sent out.

Corresponding to these three types of tape cartridges 100A, 100B, 100C with different thicknesses, three thickness detection switches 65 are arranged in a dispersed manner in the circumferential direction on the loading peripheral wall portion 33. Each thickness detection switch 65 is made up of a push switch (microswitch), for example. Of the three thickness detection switches 65, a first detection switch 65A is arranged near the print head 21 (head cover 43), a second detection switch 65B is arranged near the above tape detection section 51, and a third detection switch 65C is arranged near the one small protrusion 55.

As will be described later, these three thickness detection switches 65A, 65B, 65C are arranged in such a way that their distance of placement from the loading base portion 31 differs, according to the thicknesses of the three types of tape cartridges 100A, 100B, 100C. Then, the three thickness detection switches 65A, 65B, 65C are each connected to a detection circuit (not illustrated), and the detection circuit detects the thickness of the loaded tape cartridge 100 on the basis of binary data of detection and non-detection, which is ON-OFF of each thickness detection switch 65.

Figure 4:
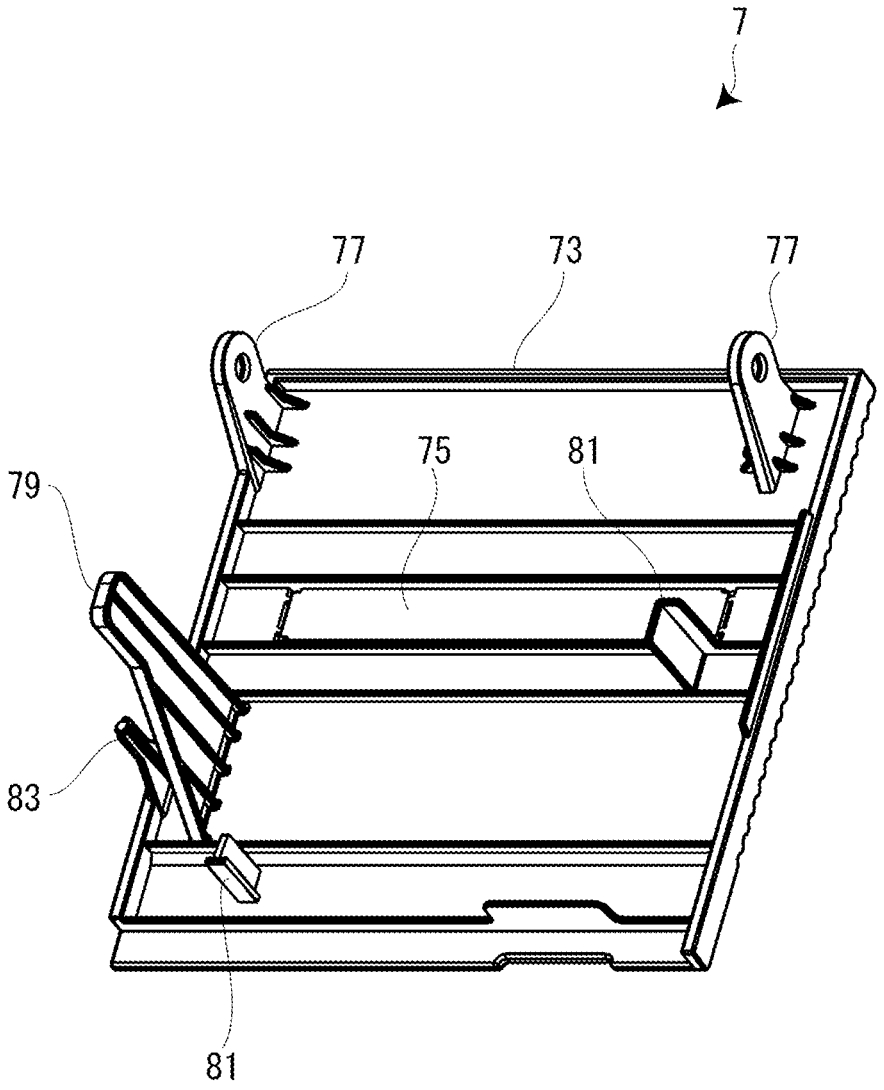
FIG. 4 is a perspective view of an open/close cover, as viewed from the back side.

As shown in FIG. 1 and FIG. 4, the open/close cover 7 is mounted on the device case 3 via a hinge portion 71 provided on the rear side, in such a way as to be able to swivel, that is, to be able to open/close. The open/close cover 7 includes an open/close cover main body 73, and a view window 75 provided at the center of the open/close cover main body 73. Also, the open/close cover 7 includes a pair of shaft support pieces 77 provided in a protruding manner on the back of the open/close cover main body 73 and axially supported on the hinge portion 71 in such a way as to be able to swivel, and an actuation lever 79 which is provided in a protruding manner on the back of the open/close cover main body 73 and causes the print head 21 to swivel. Moreover, the open/close cover 7 includes two push-in protrusions 81 which are provided in a protruding manner on the back of the open/close cover main body 73 and push in the tape cartridge 100, and a press protrusion 83 which is provided in a protruding manner on the back of the open/close cover main body 73 and actuates (turns ON) a built-in cover closing detection switch (not illustrated).

The view window 75 is formed to be laterally long and made of a transparent resin (transparent to visible rays) as a separate member from the open/close cover main body 73. Through this view window 75, the tape cartridge 100 loaded in the cartridge loading section 5 can be visually confirmed (the type of the print tape 102 and the amount of tape left). Also, the pair of shaft support pieces 77, the actuation lever 79, the two push-in protrusions 81 and the press protrusion 83, and the open/close cover main body 73 are integrally formed (molded) of a resin.

The actuation lever 79 protrudes largely from the back of the open/close cover main body 73. With the closing of the open/close cover 7, the actuation lever 79 is inserted in a slit opening 87 provided to the lateral side of the cartridge loading section 5. The actuation lever 79 inserted in the slit opening 87 actuates the above head release mechanism and causes the print head 21 to swivel toward the platen roller 120. Similarly, with the closing of the open/close cover 7, the press protrusion 83 is inserted in a rectangular opening 91 next to the slit opening 87 and actuates the cover closing detection switch.

One push-in protrusion 81 corresponds to a position near the platen roller 120 of the tape cartridge 100. The other push-in protrusion 81 corresponds to a position directly above the above tape detection section 51. As the open/close cover 7 is closed, the two push-in protrusions 81 push in the tape cartridge 100 so that the tape cartridge 100 sits on the loading base portion 31 of the cartridge loading section 5, and the push-in protrusions 81 also prevent the tape cartridge 100 from floating up.

[Details of Tape Cartridge]

Next, the tape cartridge 100 will be described in detail, referring to FIGS. 2A, 2B, 5A, 5B, and 6. In the description of the tape cartridge 100, taking FIGS. 2A and 2B as an example, the forward side in the loading direction, which is the top front side of the tape cartridge 100, is referred to as the "front side", the rear side in the loading direction, which is the opposite side, as the "back side", the lateral side on the left as the "left lateral side", the lateral side on the right as the "right lateral side", the arcuate side on the top as the "distal side", and the side on the bottom as the "proximal side".

The tape cartridge 100 includes the cartridge case 130, and the tape roll 106, the ribbon roll 114, the take-up core 116 and the platen roller 120 accommodated therein, as described above. Also, the tape cartridge 100 has the insertion opening 134 formed in the cartridge case 130, the tape outlet port 138 formed on the left lateral side, near the platen roller 120, and an identification seal 141 (see FIG. 1) bonded over the front side, the left lateral side and the right lateral side of the part where the tape roll 106 is accommodated. The identification seal 141 shows the tape width, tape color, material and the like of the print tape 102 accommodated in the cartridge case 130, at the two parts of the front side and the left lateral side.

The cartridge case 130 forms the outer shell of the tape cartridge 100 (shell structure) and has an "L"-shaped appearance as viewed in a plan view, with the proximal side part on the right lateral side slightly protruding. In the front-back direction, the cartridge case 130 is formed by a lower case 150 which comes to the rear side when the tape cartridge is loaded in the cartridge loading section 5, and an upper case 152 which comes to the forward side. In the cartridge case 130 in this embodiment, the upper case 152 is formed by a molded member of a resin which is transparent enough to enable visibility of the accommodated print tape 102, and the lower case 150 is formed by a molded member of an opaque resin.

The upper case 152 is integrally formed (molded) by a top wall portion 156 forming the front side of the cartridge case 130, and an upper peripheral wall portion 158 suspended on a circumferential edge part of the top wall portion 156. Meanwhile, the lower case 150 is integrally formed (molded) by a bottom wall portion 160 forming the back side of the cartridge case 130, a lower peripheral wall portion 162 provided upright on a circumferential edge part of the bottom wall portion 160, and an opening peripheral wall portion 164 provided upright on the bottom wall portion 160 so as to define the above insertion opening 134.

Figures 5A, 5B:
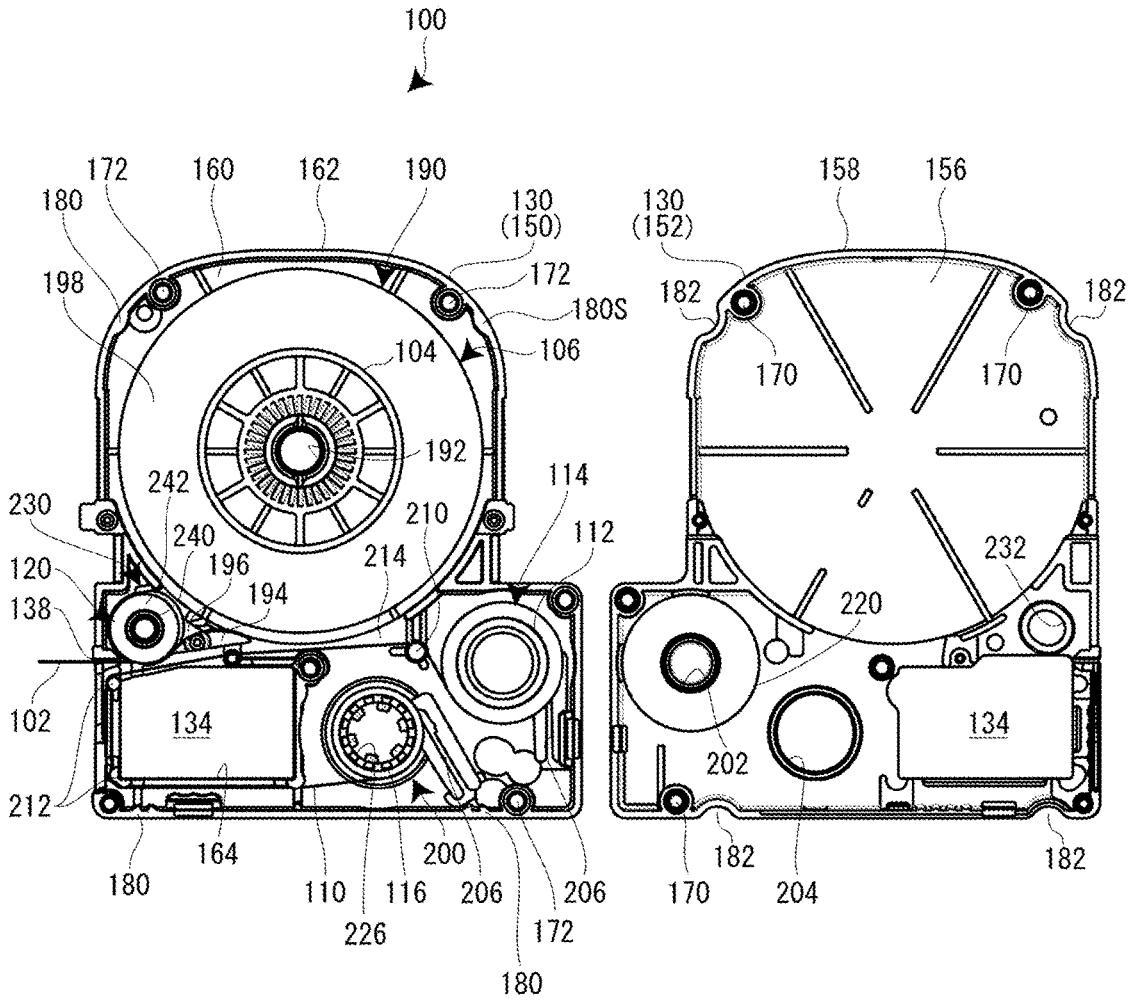
FIG. 5A is a plan view of an upper case and the tape cartridge in the state where the upper case is removed.
FIG. 5B is a back view of the upper case.

A plurality of joint pins 170 is provided at a proper interval on a lower end surface of the upper peripheral wall portion 158 of the upper case 152, whereas a plurality of joint holes 172 corresponding to the plurality of joint pins 170 is provided in the lower peripheral wall portion 162 of the lower case 150 (see FIGS. 5A and 5B). After components such as the tape roll 106 and the ribbon roll 114 are set in the lower case 150, the upper case 152 is joined thereto in such a way that the plurality of joint pins 170 is press-fitted in the plurality of joint holes 172, thus assembling the tape cartridge 100. Each joint hole 172 is a through-hole in consideration of easiness of molding.

Figure 2A:
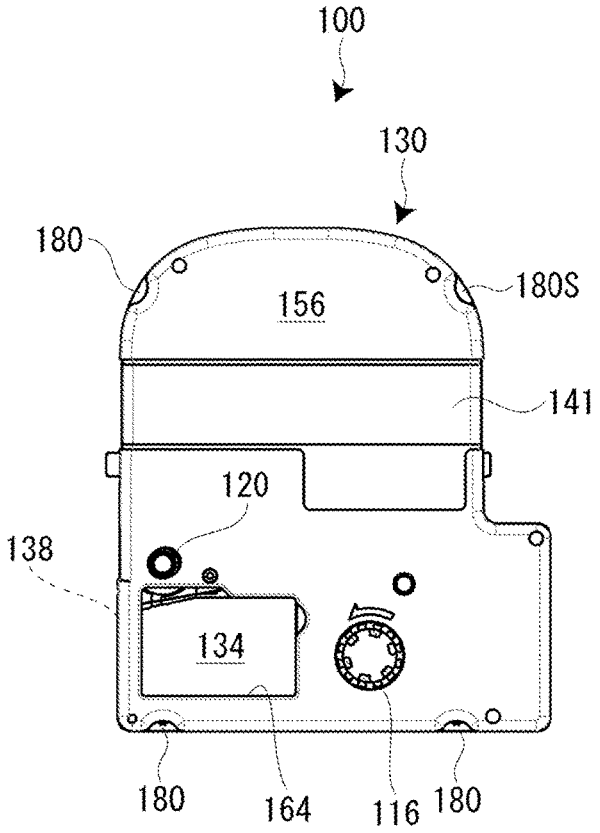
FIG. 2A is a plan view and FIG. 2B is a side view of the tape cartridge according to the embodiment.
Figure 2B:
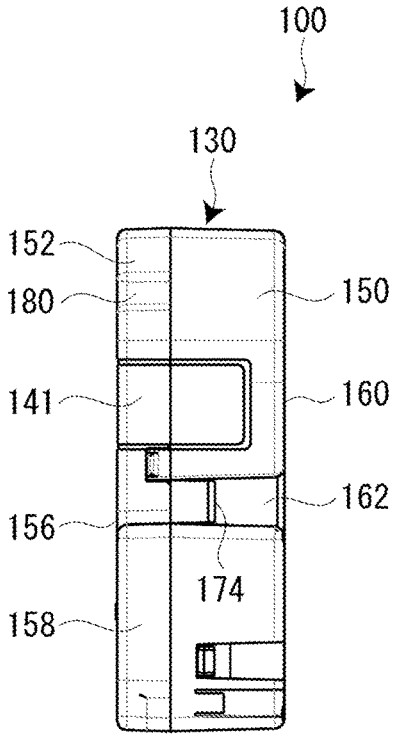
Figure 6:
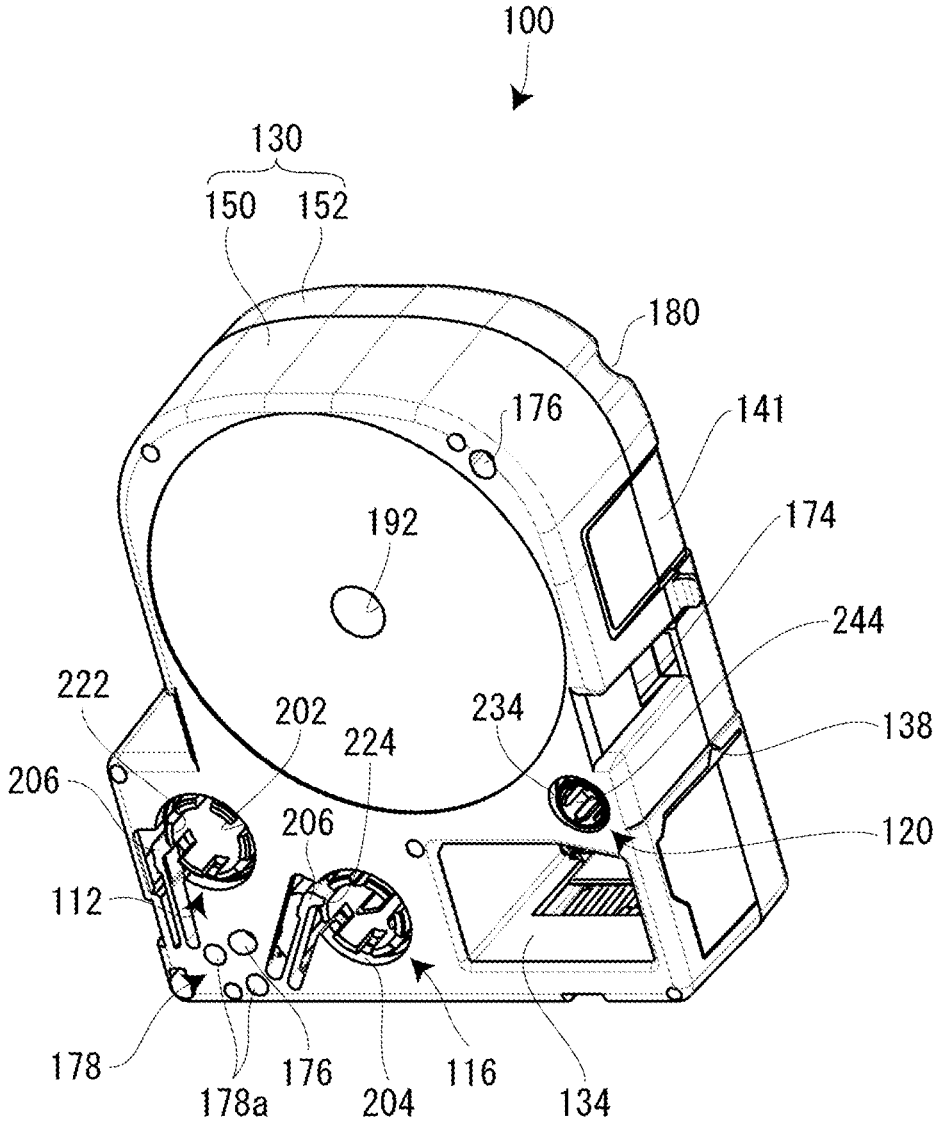
FIG. 6 is a perspective view of the tape cartridge, as viewed from the back side.
Figure 7A:
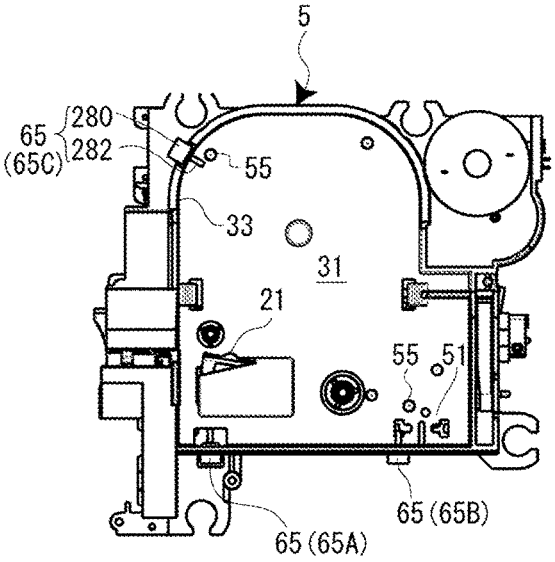
FIG. 7A is a plan view.
Figure 7C:
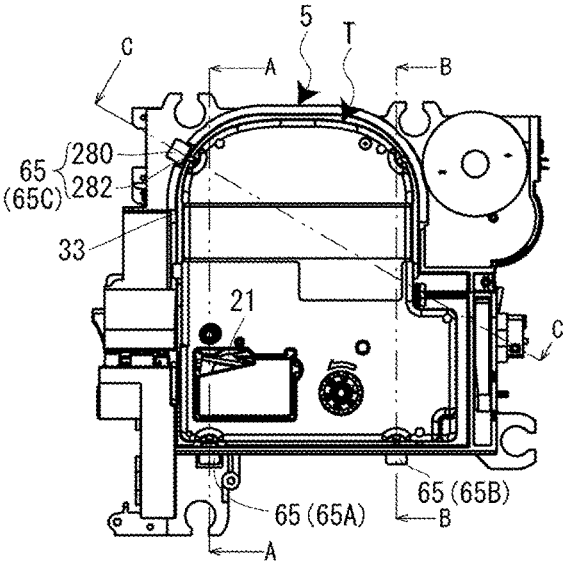
FIG. 7C is a plan view of the state where the tape cartridge is loaded.
Figure 7B:
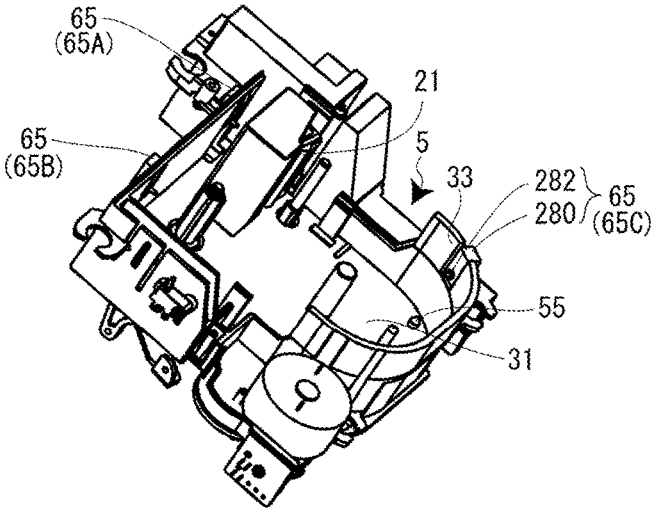
FIG. 7B is a perspective view of the cartridge loading section.
Figure 8A:
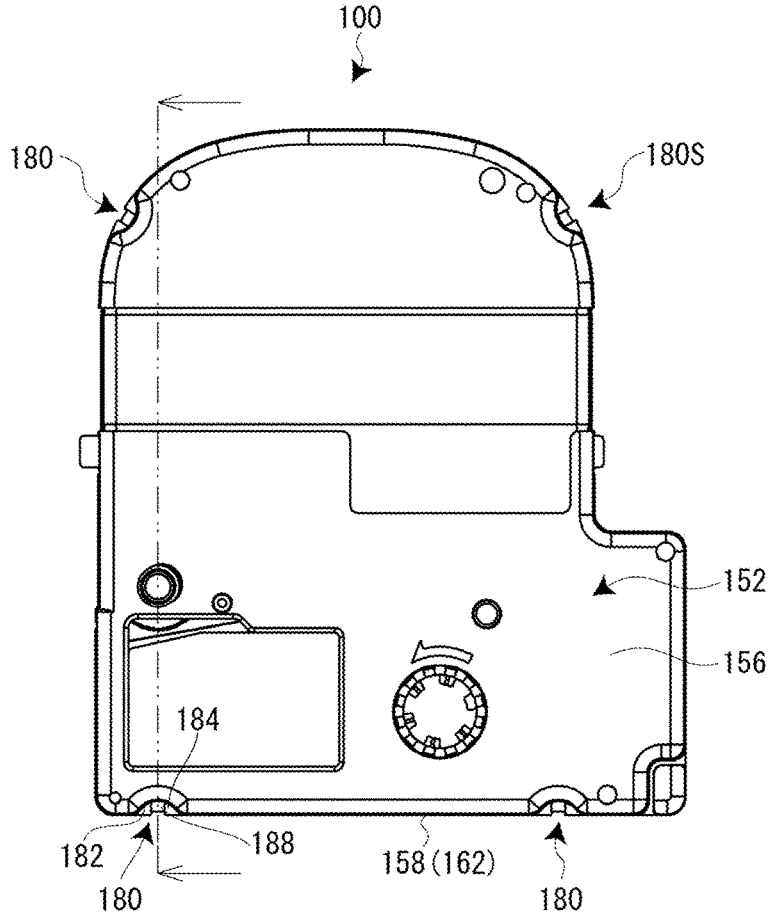
FIG. 8A is a plan view and FIG. 8B is a cross-sectional view of the tape cartridge.
Figure 8B:
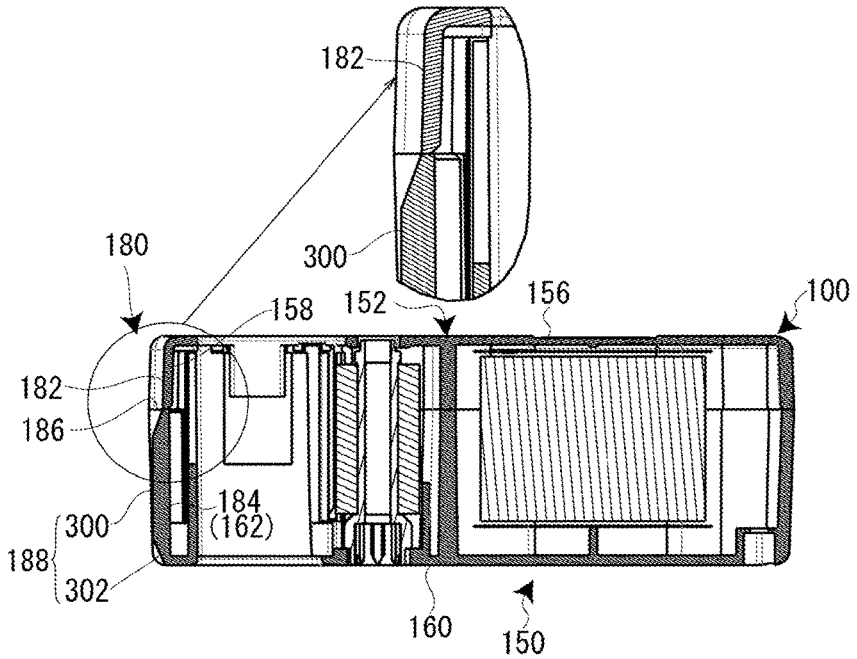

Meanwhile, a pair of hook receiving portions 174 to be hooked on the above pair of hook pieces 57 is provided on the left lateral side and the right lateral side of the lower case 150 (see FIGS. 2A and 2B and FIG. 6). As the pair of hook pieces 57 on the side of the cartridge loading section 5 is hooked on the pair of hook receiving portions 174 of the loaded tape cartridge 100, the tape cartridge 100 is prevented from floating up. Also, fitting small holes 176 in which the above pair of small protrusions 55 is fitted with a certain margin are provided on the back side of the lower case 150 (see FIG. 6). As the pair of small protrusions 55 on the side of the cartridge loading section 5 is fitted in the pair of fitting small holes 176 in the loaded tape cartridge 100, the tape cartridge 100 is easily positioned on the loading base portion 31.

Moreover, on the back side of the lower case 150, the detection receiving section 178 corresponding to the above tape detection section 51 is provided at a position in the left corner on the proximal side (right corner as viewed from the front side) (see FIG. 6). The detection receiving section 178 is formed in a section corresponding to the plurality of microswitches 51*a* of the detection section 51, and a plurality of bit patterns is acquired according to the presence/absence of receiving holes 178*a* provided in this section. That is, the bit patterns correspond to the type of the above print tape 102 except tape width.

Meanwhile, as shown in FIGS. 2A, 2B, 5A, 5B, 8A, and 8B, recessed portions 182 are formed at four positions in the circumferential direction on the upper peripheral wall portion 158 of the upper case 152. Also, corresponding to these four recessed portions 182, thick portions 184 are formed at four positions in the circumferential direction on the lower peripheral wall portion 162 of the lower case 150. Then, the end surface on the side of the upper peripheral wall portion 158, of each thick portion 184, forms an abutting surface 186 against which a part of a dismantling jig (not illustrated), described later, abuts.

Although not particularly illustrated, the dismantling jig includes four support poles which receive the tape cartridge 100 with its front and back reversed, at the parts of the abutting surfaces 186 at the above four positions, and four extraction pins inserted in the four joint holes 172 in the lower case 150 formed as through-holes, when dismantling the tape cartridge 100 after use. In the state where the tape cartridge 100 is set on the four support poles, the four extraction pins are lowered and inserted in the four joint holes 172 from the back side of the lower case 150. Thus, the four extraction pins work to simultaneously push out (extract) the four joint pins 170 on the upper case 152, thus dismantling the lower case 150 and the upper case 152.

In this way, the recessed portions 182 at the four positions on the upper case 152, and the thick portions 184 at the four positions and the abutting surfaces 186 at the four positions on the lower case 150 are formed in the cartridge case 130 as required dismantling sites on the tape cartridge 100. Also, these recessed portions 182, thick portions 184 and abutting surfaces 186 form sections to be detected 180 of the tape cartridge 100 corresponding to the above thickness detection switches 65, as well as slide portions 188 formed on the outside of the thick portions 184. In the embodiment, sections to be detected 180 at three positions, of the sections to be detected 180 at the four positions, correspond to the above three thickness detection switched 65 (details thereof will be described later).

As shown in FIGS. 5A and 5B, a broad tape accommodation area 190 in which the tape roll 106 is accommodated is formed in a space on the upper side (distal end surface side) in the cartridge case 130. At the center of the tape accommodation area 190, the core shaft 192 integrally formed (molded) with the lower case 150 is provided upright. The core shaft 192 is cylindrically formed, and on its outer circumferential surface, the tape roll 106 (tape core 104) is rotatably axially supported. Also, in the tape accommodation area 190, near the platen roller 120, a tape guide 194 which guides the reeled-off print tape 102 to the platen roller 120 is provided upright integrally with the lower case 150.

That is, inside the cartridge case 130, a tape feed path 196 is formed, starting at the tape roll 106 and reaching the tape outlet port 138 via the tape guide 194 and the platen roller 120. The print tape 102 reeled off from the tape roll 106 is guided to the platen roller 120 via the tape guide 194, used for printing there, and further guided from the platen roller 120 to the tape outlet port 138.

The tape roll 106 has the print tape 102 and the tape core 104, and also has two films 198 bonded to both end surfaces of the print tape 102 in a roll shape. The two films 198 prevent the print tape 102 wound on the tape core 104 from unwinding. Also, a reverse rotation stopper mechanism is incorporated in the tape core 104, though not illustrated. When carrying the tape cartridge 100, reverse rotation of the print tape 102 is prevented by this reverse rotation stopper mechanism. Meanwhile, when the tape cartridge 100 is loaded in the cartridge loading section 5 of the tape printing device 1, the reverse rotation stopper by the reverse rotation stopper mechanism is cancelled by the above positioning protrusion 41, thus enabling the print tape 102 to be fed.

On the right side of the proximal part in the cartridge case 130, a ribbon accommodation area 200 is formed next to the insertion opening 134. To the right in the ribbon accommodation area 200, a reel-off side bearing portion 202 which rotatably supports the ribbon roll 114 (reel-off core 112), and to the left, a take-up side bearing portion 204 which rotatably supports the take-up core 116, are formed integrally with the cartridge case 130. That is, the reel-off side bearing portion 202 and the take-up side bearing portion 204 are formed each in the upper case 152 and the lower case 150.

In cut-out parts of the reel-off side bearing portion 202 and the take-up side bearing portion 204 formed in the lower case 150, rotation stopper hooks 206 having their distal parts facing the reel-off side bearing portion 202 and the take-up side bearing portion 204 are integrally formed, respectively. Then, one rotation stopper hook 206 is engaged with the reel-off core 112 and the other rotation stopper hook 206 is engaged with the take-up core 116, each in a rotation stopping state.

In the ribbon accommodation area 200, near the reel-off side bearing portion 202, a first ribbon guide 210 which guides the reeled-off ink ribbon 110 to the platen roller 120 is provided upright integrally with the lower case 150. Also, on the outer circumferential side of the above opening peripheral wall portion 164, a plurality of second ribbon guides 212 which guides the circular movement of the ink ribbon 110 is integrally formed.

That is, inside the cartridge case 130, a ribbon feed path 214 is formed, starting at the ribbon roll 114 and reaching the take-up core 116 via the first ribbon guide 210, the platen roller 120 and the plurality of second ribbon guides 212. The ink ribbon 110 reeled off from the ribbon roll 114 is guided to the platen roller 120 via the first ribbon guide 210, is used for printing there, then further travels around the opening peripheral wall portion 164 (the plurality of second ribbon guides 212) from the platen roller 120, and is taken up on the take-up core 116.

The ribbon roll 114 has the ink ribbon 110 and the reel-off core 112, and also has a ring-shaped leaf spring 220 which applies a braking load to the reel-off core 112 (see FIG. 5B). The leaf spring 220 is formed in a wave shape in the circumferential direction and is provided between the top wall portion 156 of the upper case 152 and the reel-off core 112 in the axial direction. That is, a rotation braking load is applied to the reel-off core 112 by the spring force of this leaf spring 220. Thus, a back tension is applied to the ink ribbon 110 being reeled off by the take-up core 116, thus preventing the ink ribbon 110 from loosening.

The reel-off core 112 is cylindrically formed, and at its end on the side of the lower case 150, a plurality of cut-outs 222 is formed in the circumferential direction (see FIG. 6). Then, the above rotation stopper hooks 206 are to be engaged with and disengaged from the plurality of cut-outs 222. While the reel-off side bearing portion 202 on the side of the lower case 150 supporting the reel-off core 112 is formed as a circular opening, the reel-off side bearing portion 202 on the side of the upper case 152 is formed as a cylindrical protruding part. Then, the above leaf spring 220 is mounted on this protruding part (see FIG. 5B for each of these parts).

Similarly, the take-up core 116 is cylindrically formed, and at its end on the side of the lower case 150, a plurality of cut-outs 224 is formed in the circumferential direction. Then, the above rotation stopper hooks 206 are engaged with and disengaged with the plurality of cut-outs 224. Also, a spline groove 226 is formed on the inner circumferential surface of the take-up core 116 and spline-engaged with the above take-up drive shaft 47. Thus, the rotational force of the take-up drive shaft 47 is transmitted to the take-up core 116, and the ink ribbon 110 is taken up.

On the left side of the proximal part in the cartridge case 130, a platen accommodation area 230 is formed next to the insertion opening 134. In the center of the platen accommodation area 230, a lower bearing portion 234 (see FIG. 6) in the form of an elliptic opening formed in the lower case 150, and an upper bearing portion 232 (see FIG. 5B) in the form of an oval (elliptic) opening formed in the upper case 152 are provided. Then, on the upper bearing portion 232 and the lower bearing portion 234, the platen roller 120 is supported in a rotatable and slightly laterally movable manner. That is, the platen roller 120 supported on the upper bearing portion 232 and the lower bearing portion 234, which are elliptical, is configured to be laterally movable (slightly movable) between a home position where the platen roller 120 is engaged with the platen drive shaft 45 and a nipping position where the platen roller 120 abuts against the tape guide 194 with the print tape 102 nipped between them.

Incidentally, this tape cartridge 100 is carried in the state where the reel-off end of the print tape 102 is slightly protruding outward from the tape outlet port 138 (see FIG. 1). In this case, if a push-in force or pull-in force acts on the reel-off end of the print tape 102 by mistake, the platen roller 120, which is drawn by this, moves to the above nipping position. Thus, the reel-off end of the print tape 102 is prevented from being pulled into the cartridge case 130 from the tape outlet port 138.

The platen roller 120 has a cylindrical roller base 240 and a rubber roller 242 mounted on the outer circumferential surface of the roller base 240. The rubber roller 242 has a length corresponding to the print head 21 in the axial direction. The print head 21, having moved to the printing position, abuts against this rubber roller 242 with the print tape 102 and the ink ribbon 110 held between them. Also, a spline groove 244 is formed on the inner circumferential surface of the roller base 240 and spline-engaged with the above platen drive shaft 45. Thus, the rotational force of the platen drive shaft 45 is transmitted to the platen roller 120, and the print tape 102 (and the ink ribbon 110) is fed for printing.

Thickness Detection Switch (First Embodiment)

Next, referring to FIG. 3, FIGS. 7A-7C and FIGS. 9A-9C, the structure of the thickness detection switches 65 provided in the cartridge loading section 5 according to an embodiment (first embodiment) will be described in detail along with the structure of the sections to be detected 180 of the tape cartridge 100. As described above, the three thickness detection switches 65 are provided on the loading peripheral wall portion 33 of the cartridge loading section 5, and corresponding to these, the sections to be detected 180 are provided at three positions and a spare section to be detected 180S is formed at one position, on the outer circumferential surface of the tape cartridge 100.

As shown in FIG. 3, FIGS. 7A-7C and FIGS. 9A-9C, the three thickness detection switches 65 are arranged in a dispersed manner in the circumferential direction on the loading peripheral all portion 33 of the cartridge loading section 5. As described above, the first detection switch 65A is arranged near the print head 21. The second detection switch 65B is arranged near the tape detection section 51. The third detection switch 65C is arranged near the one small protrusion 55.

Each thickness detection switch 65 is made up of a push switch. Each thickness detection switch 65 has a switch main body 280 attached to the loading peripheral all portion 33, and a stem 282 which is supported on the switch main body 280 in such a way as to be able to move forward and backward and which comes in contact with the tape cartridge 100 (cartridge case 130) and actuates (turns ON-OFF) the switch main body 280 (see FIGS. 9A-9C).

The stem 282 moves forward and backward between a protruding position where the stem 282 protrudes from the switch main body 280 in a direction intersecting with the loading direction, that is, substantially in a horizontal direction, and a push-in position where the stem 282 is pressed and pushed in by the tape cartridge 100 loaded in the cartridge loading section 5. Also, the stem 282 is energized in a direction away from the switch main body 280, that is, in the protruding direction, by a built-in spring (not illustrated). Then, as the method for using the thickness detection switch 65, the state where the stem 282 is protruding to the protruding position by the spring force of the built-in spring is regarded as the state where the thickness detection switch 65 (switch main body 280) is "OFF", whereas the state where the stem 282 is pushed in to the push-in position against the built-in spring is regarded as the state where the thickness detection switch 65 (switch main body 280) is "ON".

That is, in the state where the stem 282 is situated in the recessed portion 182 of the cartridge case 130 or on a release guide slope 304 of the slide portion 188, the stem 282 is protruding to the protruding position and the thickness detection switch 65 is OFF. Meanwhile, in the state where the stem 282 is in contact with a contact surface 300 of the slide portion 188 of the cartridge case 130, the stem 282 is pressed to the push-in position and the thickness detection switch 65 is ON.

Also, when the tape cartridge 100 is loaded in the cartridge loading section 5, as the stem 282 moves relatively to the release guide slope 304 from the contact surface 300 of the slide portion 188, the switch main body 280 (thickness detection switch 65) switches from ON to OFF. Similarly, when the tape cartridge 100 is released from the cartridge loading section 5, as the stem 282 moves relatively to the contact surface 300 from the release guide slope 304, the switch main body 280 (thickness detection switch 65) switches from OFF to ON.

The first detection switch 65A is arranged in such away that the stem 282 faces and is pressed by the contact surface 300 of the tape cartridge 100, no matter which thickness the loaded tape cartridge 100 has. In other words, the first detection switch 65A is arranged in such a way that the stem 282 faces and is pressed by the contact surface 300 to the push-in position so as to actuate (turn ON) the switch main body 280.

Figures 10A, 10B:
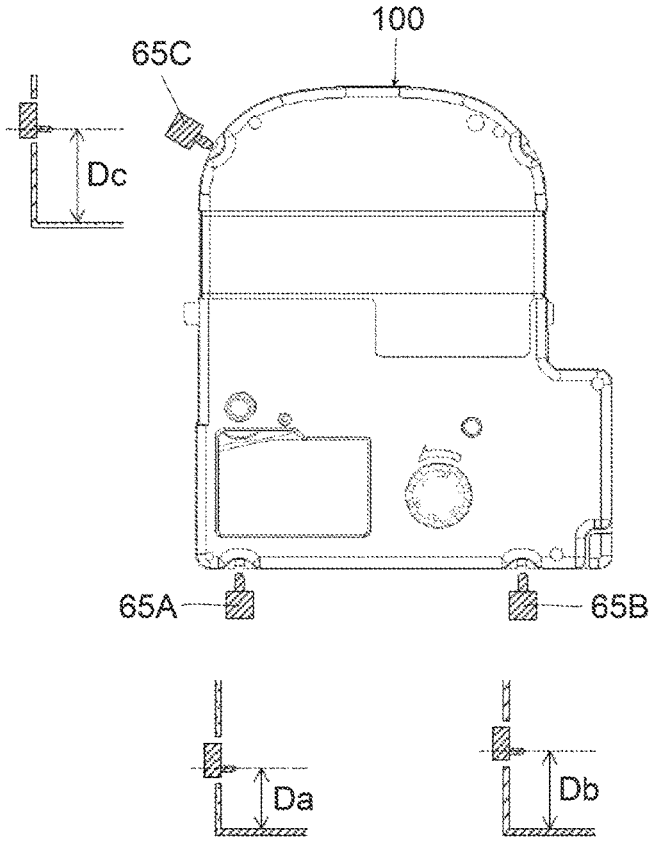
FIGS. 10A and 10B are explanatory views showing a thickness detection method for the tape cartridge, using a plurality of width detection switches.

Specifically, the first detection switch 65A is arranged at a distance Da in the direction opposite to the loading direction, that is, in the upward direction, from the loading base portion 31, that is, at a low position in the cartridge loading section 5 (see FIGS. 10A and 10B).

Similarly, the second detection switch 65B is arranged in such a way that when the relatively thin tape cartridge 100A is loaded, the stem 282 faces the release guide slope 304 of this tape cartridge 100A and switches OFF. Also, the second detection switch 65B is arranged in such a way that when the medium-thickness tape cartridge 100B is loaded, the stem 282 faces the contact surface 300 of this tape cartridge 100B and switches ON. Moreover, the second detection switch 65B is arranged in such a way that when the relatively thick tape cartridge 100C is loaded, the stem 282 faces the contact surface 300 of this tape cartridge 100C and switches ON.

Specifically, the second detection switch 65B is arranged at a distance Db (>Da) in the upward direction from the loading base portion 31, that is, at a middle position in the cartridge loading section 5 (see FIGS. 10A and 10B).

Similarly, the third detection switch 65C is arranged in such away that when the relatively thin tape cartridge 100A is loaded, the stem 282 faces the recessed portion 182 of this tape cartridge 100A and switches OFF. Also, the third detection switch 65C is arranged in such a way that when the medium-thickness tape cartridge 100B is loaded, the stem 282 faces the release guide slope 304 of this tape cartridge 100B and switches OFF. Moreover, the third detection switch 65C is arranged in such a way that when the relatively thick tape cartridge 100C is loaded, the stem 282 faces the contact surface 300 of this tape cartridge 100C and switches ON.

Specifically, the third detection switch 65C is arranged at a distance Dc (>Db) in the upward direction from the loading base portion 31, that is, at a high position in the cartridge loading section 5 (see FIGS. 10A and 10B).

Figure 9A:
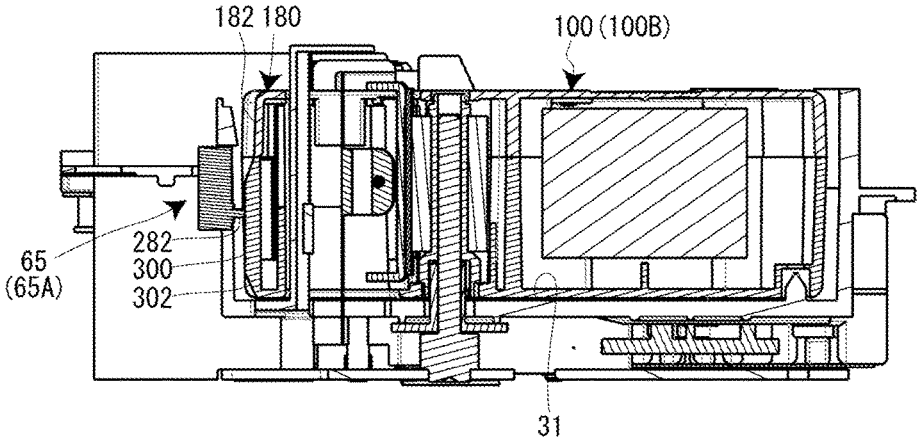
FIG. 9A is a cross-sectional view taken along A-A in FIG. 7C.
Figure 9B:
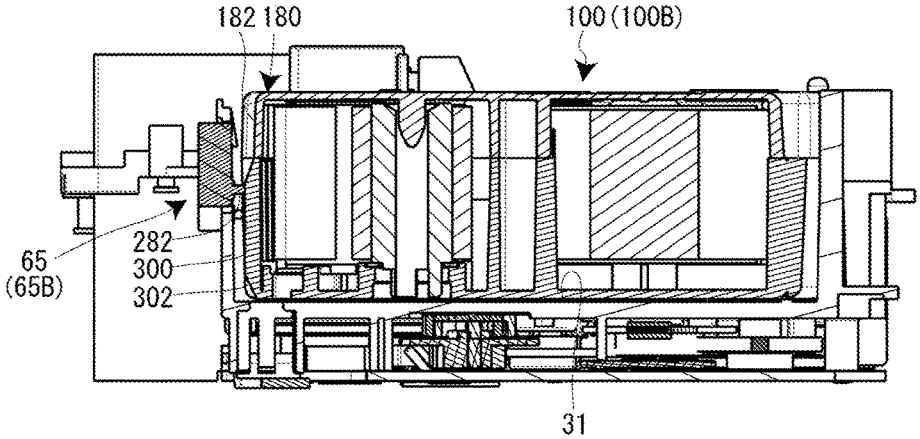
FIG. 9B is a cross-sectional view taken along B-B in FIG. 7C.
Figure 9C:
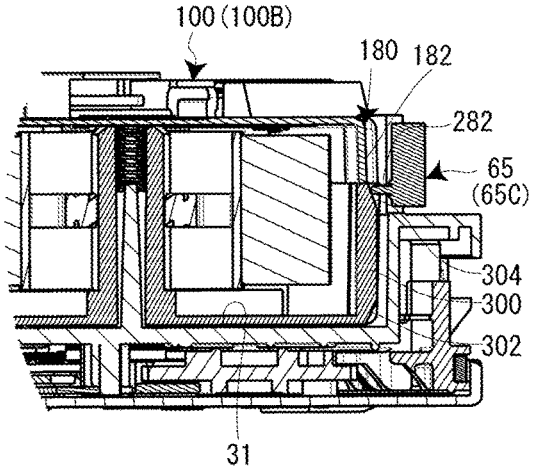
FIG. 9C is a cross-sectional view taken along C-C in FIG. 7C.

As will be described in detail later, when the medium-thickness tape cartridge 100B is loaded in the cartridge loading section 5, for example, the first detection switch 65A is ON, the second detection switch 65B is ON, and the third detection switch 65C is OFF (see FIGS. 9A-9C). The above detection circuit connected to these three thickness detection switches 65 detects the type related to the thickness of the loaded tape cartridge 100, on the basis of whether each of the first detection switch 65A, the second detection switch 65B and the third detection switch 65C is ON or OFF (see FIGS. 10A and 10B).

Meanwhile, as shown in FIGS. 8A, 8B, and 9A-9C, the sections to be detected 180 are provided at three positions on the outer circumferential surface of the tape cartridge 100, corresponding to the three thickness detection switches 65. As described above, each section to be detected 180 has the recessed portion 182 concavely formed in the upper peripheral wall portion 158 of the upper case 152, the thick portion 184 formed in the lower peripheral wall portion 162 of the lower case 150 corresponding to the recessed portion 182, the abutting surface 186, which is the end surface on the side of the upper peripheral wall portion 158, of the thick portion 184, and the slide portion 188 concavely formed on the outer surface of the thick portion 184.

The recessed portion 182 is a groove-like site where the thickness detection switch 65 facing this part becomes OFF, and is concavely formed with an arcuate cross section toward the inside. Also, the recessed portion 182 is formed continuously from the top end to the bottom end of the upper peripheral wall portion 158 including the top wall portion 156, across the thickness of the upper case 152. The stem 282 of the thickness detection switch 65 facing the recessed portion 182 protrudes from the switch main body 280 to the protruding position and the thickness detection switch 65 turns OFF.

The thick portion 184 is formed with an arcuate cross section following the recessed portion 182. However, the thick portion 184 in this case is formed with an arcuate cross section that is larger than the recessed portion 182 by the amount of the thickness of the upper peripheral wall portion 158. Also, the abutting surface 186 equivalent to the end surface on the side of the recessed portion 182 (on the side of the upper peripheral wall portion 158), of the thick portion 184, is formed in the same shape as the cross-sectional shape of the thick portion 184.

The slide portion 188 is formed continuously from the top end to the bottom end of the lower peripheral wall portion 162 across the thickness of the lower case 150. The slide portion 188 has a loading guide slope 302 provided at a bottom end part, and the contact surface 300 connected to the upper side of the loading guide slope 302. Moreover, a part of the slide portion 188 has the release guide slope 304 connected to the upper side of the contact surface 300.

The contact surface 300 is formed substantially parallel to the loading direction. The loading guide slope 302 is tilted in the protruding direction of the stem 282, on the rear side in the loading direction, that is, on the lower side. The loading guide slope 302 presses the stem 282 to the push-in position when the tape cartridge 100 is loaded into the cartridge loading section 5. Meanwhile, the release guide slope 304 is tilted in the protruding direction of the stem 282, on the front side in the loading direction, that is, on the upper side. The loading guide slope 302 cancels the pushing in of the stem 282 in the state where the tape cartridge 100 has been loaded in the cartridge loading section 5, and presses the stem 282 to the push-in position when the tape cartridge 100 is released from the cartridge loading section 5.

More specifically, for the relatively thin tape cartridge 100A, the two sections to be detected 180 corresponding to the second detection switch 65B and the third detection switch 65C, of the three sections to be detected 180, have the loading guide slope 302. For the medium-thickness tape cartridge 100B, the one section to be detected 180 corresponding to the third detection switch 65, of the three sections to be detected 180, has the loading guide slope 302 (see FIGS. 9A-9C). Meanwhile, for the relatively thick tape cartridge 100C, none of the three sections to be detected 180 has the loading guide slope 302.

The section to be detected 180 corresponding to the first detection switch 65A in the relatively thin tape cartridge 100A is formed with a slope similar to the loading guide slope 302. However, this slope may be omitted. That is, the edge part at the top end of the section to be detected 180 may be formed with a substantially right-angled cross section. The same applies to the sections to be detected 180 corresponding to the first detection switch 65A and the second detection switch 65B in the medium-thickness tape cartridge 100B, and the three sections to be detected 180 in the relatively thick tape cartridge 100C.

Incidentally, to cope with the difference in thickness among the plurality of types of tape cartridges 100, adjustments are made with the thickness of the lower case 150, as described above. That is, in the loaded tape cartridge 100, the height position from the loading base portion 31 of the release guide slope 304 formed at the top end of the lower case 150 is a fixed position that indicates the thickness of the tape cartridge 100.

Therefore, when the relatively thin tape cartridge 100A ("12-mm-wide cartridge") is loaded in the cartridge loading section 5, the first detection switch 65A is ON and the second detection switch 65B and the third detection switch 65C are OFF.

Also, when the medium-thickness tape cartridge 100B ("18-mm-wide cartridge") is loaded, the first detection switch 65A and the second detection switch 65B are ON and the third detection switch 65C is OFF.

Moreover, when the relatively thick tape cartridge 100C ("24-mm-wide cartridge") is loaded, all of the first detection switch 65A, the second detection switch 65B and the third detection switch 65C are ON.

[Detection of Thickness of Tape Cartridge]

FIGS. 10A and 10B show a method for detecting the thickness (type) of the tape cartridge 100. As shown in FIG. 10A, the three thickness detection switches 65A, 65B, 65C are provided in such a way as to have different distances in the direction opposite to the loading direction, that is, in the upward direction, from the loading base portion 31.

Then, as shown in FIG. 10B, the detection circuit determines that the relatively thin tape cartridge 100A is loaded, when the first detection switch 65A is ON and the second detection switch 65B and the third detection switch 65C are OFF.

Similarly, as shown in FIG. 10B, the detection circuit determines that the medium-thickness tape cartridge 100B is loaded, when the first detection switch 65A and the second detection switch 65B are ON and the third detection switch 65C is OFF.

Similarly, as shown in FIG. 10B, the detection circuit determines that the relatively thick tape cartridge 100C is loaded, when all of the first detection switch 65A, the second detection switch 65B and the third detection switch 65C are ON.

As described above, according to the embodiment, since the three sections to be detected 180 corresponding to the three thickness detection switches 65 are provided on the outer circumferential surface of the cartridge case 130, an increase in the size of the tape cartridge 100 due to the provision of the sections to be detected 180 can be restrained. Also, since the thickness of the tape cartridge 100 is detected using the thickness of the lower case 150, the complication of the structure of the tape cartridge 100 due to the provision of the sections to be detected 180 can be restrained and the thickness detection can be securely carried out. Moreover, the sections to be detected 180 can also be used as required dismantling sites for dismantling the tape cartridge 100.

Also, since the spring force of the thickness detection switch 65 acts on the tape cartridge 100 from the lateral side, the misalignment of the tape cartridge 100 can be prevented by the three thickness detection switches 65 arranged in a dispersed manner. Particularly, the first detection switch 65A, the second detection switch 65B, and the third detection switch 65C are arranged in this order away from the platen roller 120 receiving the pressing force from the print head 21, and the three thickness detection switches 65 are arranged and configured to resist the pressing force of the print head 21 as much as possible.

In this embodiment, the three types of tape cartridges 100 with difference thicknesses are detected. However, the numbers of the thickness detection switches 65 and the sections to be detected 180 may be increased, thus detecting three or more types of tape cartridges 100. In contrast to this, the tape cartridge 100 may be configured with only one section to be detected 180, and the push switch functioning as the thickness detection switch 65 in this embodiment may be made to function as a loading detection switch for detecting the loading/non-loading of the tape cartridge 100.

Second Embodiment

Incidentally, in the tape cartridge 100 in the embodiment, the rotational force is inputted to the platen roller 120 from the platen drive shaft 45, and the rotational force is inputted to the take-up core 116 from the take-up drive shaft 47. Therefore, a moment of rotation acts on the cartridge case 130 via the friction at the bearing part of the platen roller 120, and a moment of rotation acts on the cartridge case 130 via the friction at the bearing part of the take-up core 116. These two moments of rotation act in opposite directions to each other, and their combined force M has no vector components that cancel each other on an imaginary line L connecting the platen roller 120 and the take-up core 116 and therefore act to the maximum in a direction intersecting with the imaginary line L (see FIG. 11A).

Figure 11A:
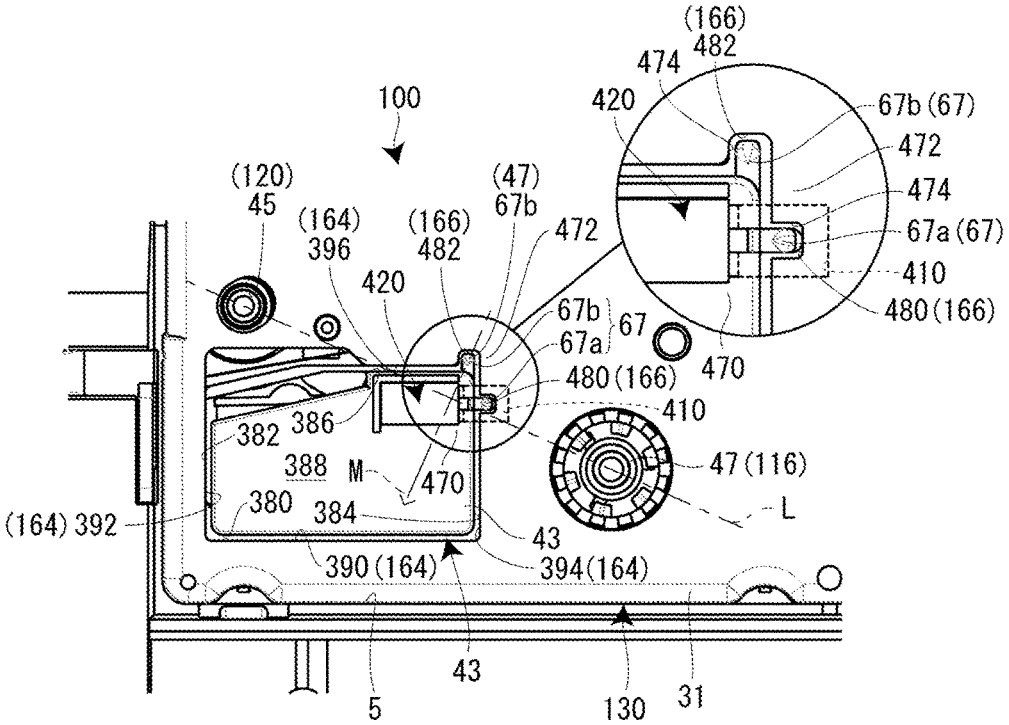
FIG. 11A is an enlarged plan view and FIG. 11B is an enlarged cross-sectional view of the peripheries of a head cover in a tape printing device according to a second embodiment.

Thus, in this embodiment, a main body-side abutting portion 67 is provided on the head cover 43, and a cartridge-side abutting portion 166 is provided on the tape cartridge 100, thus resisting the above combined force M (see FIG. 11A).

Figure 11B:
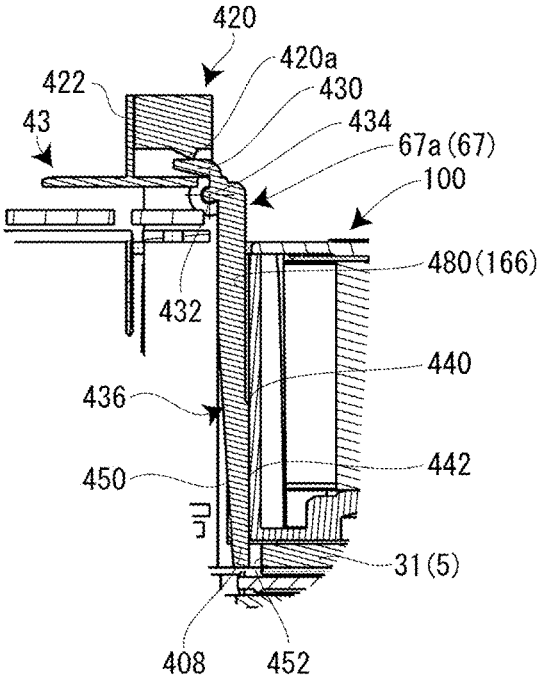

As shown in the enlarged view of FIGS. 11A and 11B, in the head cover 43 provided upright on the loading base portion 31 of the cartridge loading section 5, the main body-side abutting portion 67 is provided at an edge part 470 on the side of the above swivel support shaft 63. This main body-side abutting portion 67 is situated near the imaginary line L connecting the platen drive shaft 45 (platen roller 120) and the take-up drive shaft 47 (take-up core 116) (see FIG. 11A).

The head cover 43 has a rear cover sidewall 380 covering the back side of the print head 21, and a left cover sidewall 382 and a right cover sidewall 384 extending respectively at right angles from both outer ends of the rear cover sidewall 380. Also, the head cover 43 has a front cover sidewall 386 covering the front half part of the print head 21, and a cover top wall 388 covering the print head 21 from above. Also, these are integrally formed.

The main body-side abutting portion 67 is provided in a protruding manner (projecting manner) at the edge part 470 where the right cover sidewall 384 and the front cover sidewall 386 intersect with each other (meet each other). Specifically, the main body-side abutting portion 67 has a first projection part 67*a* provided in a projecting manner on the right cover sidewall 384 and having a rectangular cross-sectional shape, and a second projection part 67*b* provided in a projecting manner on the front cover sidewall 386 and having a rectangular cross-sectional shape. Also, the first projection part 67*a* and the second projection part 67*b* both extend to the same height as the head cover 43 from the loading base portion 31.

The second projection part 67*b* is formed (molded) integrally with the head cover 43. Meanwhile, the first projection part 67*a* is formed as a separate member from the head cover 43 and mounted on the head cover 43 in such a way as to be able to swivel. Then, a detection switch 420 (push switch) is provided on the top surface of the edge part 470 of the head cover 43, and the loading of the tape cartridge 100 is detected by the collaboration of the detection switch 420 and the first projection part 67*a* (details will be described later).

Meanwhile, the cartridge-side abutting portion 166 of the tape cartridge 100, which receives the main body-side abutting portion 67, is formed at a corner part 472 corresponding to the edge part 470, in the opening peripheral wall portion 164 defining the insertion opening 134. This cartridge-side abutting portion 166 is situated near the imaginary line L connecting the platen roller 120 and the take-up core 116 (FIG. 11A).

The opening peripheral wall portion 164 has a rear opening inner wall 390 corresponding to the rear cover sidewall 380, and a left opening inner wall 392 corresponding to the left cover sidewall 382. Also, the opening peripheral wall portion 164 has a right opening inner wall 394 corresponding to the right cover sidewall 384, and a front opening inner wall 396 corresponding to the front cover sidewall 386. Also, the rear cover sidewall 380 and the rear opening inner wall 390 face each other with a space. Similarly, the left cover sidewall 382 and the left opening inner wall 392, the right cover sidewall 384 and the right opening inner wall 394, and the front cover sidewall 386 and the front opening inner wall 396 face each other with a space.

The cartridge-side abutting portion 166 is provided in a recessed manner at the corner part 472 where the right opening inner wall 394 and the front opening inner wall 396 intersect with each other (meet each other). Specifically, the cartridge-side abutting portion 166 has a first recess part 480 provided in a recessed manner in the right opening inner wall 394, corresponding to the above first projection part 67*a*. Also, the cartridge-side abutting portion 166 has a second recess part 482 provided in a recessed manner in the front opening inner wall 396, corresponding to the above second projection part 67*b*. The first recess part 480 is formed with a rectangular cross section which is a complementary shape to the first projection part 67*a*, and the second recess part 482 is formed with a rectangular cross section which is a complementary shape to the second projection part 67*b*.

Also, both of the first recess part 480 and the second recess part 482 are formed throughout the cartridge case 130 from the front to the back. In this case, too, the first recess part 480 and the second recess part 482 each have two sidewall surfaces 474 parallel to each other. These two sidewall surfaces 474 come in contact with the corresponding lateral sides of the first projection part 67*a* and the second projection part 67*b*. Thus, the cartridge case 130 is positioned in the front-back and left-right directions.

The detection switch 420 is arranged on the top surface of the head cover 43, near the first projection part 67*a*. An attachment piece 422 is integrally provided upright on the top surface of the head cover 43, and the detection switch 420 with a stem 420*a* facing downward is attached to this attachment piece 422. The detection switch 420 is formed by a push switch with the stem 420*a* energized in the protruding direction by a built-in spring.

The first projection part 67*a* is formed as a separate member from the head cover 43 and is supported at an upper part of the head cover 43 in such a way as to be able to swivel via a swivel shaft 432. The first projection part 67*a* is integrally formed by a portion to be pressed 430 which comes in contact with the stem 420*a* from above, a support bearing portion 434 which continues from the portion to be pressed 430 and has the swivel shaft 432 provided thereon, and a projection part main body 436 which continues from the support bearing portion 434. Also, the portion to be pressed 430 extends in an "L"-shape with respect to the projection part main body 436 and is in contact with the stem 420*a* of the detection switch 420.

The lower half part of the projection part main body 436 is formed in a downwardly tapered shape. Meanwhile, a slit portion 450 which receives the lower half part of the projection part main body 436 is formed in the head cover 43. Also, the outside of the lower half part of the projection part main body 436 bulges with a step portion 440, and this bulging portion 442 is to abut against the cartridge-side abutting portion 166. Moreover, a lower end part 444 of the projection part main body 436 is loosely inserted in a rectangular opening 452 formed in the loading base portion 31.

When the tape cartridge 100 is loaded, the first projection part 67*a* (projection part main body 436) comes in contact with the first recess part 480 of the cartridge-side abutting portion 166 and slightly swivels. With this swiveling, the detection switch 420 turns ON and the loading of the tape cartridge 100 is detected. Also, when the tape cartridge 100 is unloaded, the non-loading of the tape cartridge 100 is detected by reverse procedures.

Meanwhile, the first projection part 67*a*, which swivels with the loading of the tape cartridge 100, receives an energizing force from the built-in spring of the detection switch 420 and presses (energizes) the first recess part 480 outward (to the right in the illustration). That is, when the tape cartridge 100 is loaded in the cartridge loading section 5, the tape cartridge 100 is pressed to the right in the illustration via the first projection part 67*a* and the first recess part 480.

In this way, in the second embodiment, whether the tape cartridge 100 is loaded or not can be detected by the collaboration of the detection switch 420 and the first projection part 67*a*. Also, since the spring force (built-in spring) of the detection switch 420 is made to act on the first recess part 480 via the first projection part 67*a*, the tape cartridge 100 is firmly positioned on the head cover 43 in the left-right direction. Therefore, the misalignment of the tape cartridge 100 can be effectively prevented.

Also, when the tape cartridge 100 is loaded in the cartridge loading section 5, the cartridge-side abutting portion 166 of the tape cartridge 100 is fitted with and abuts against the main body-side abutting portion 67 of the head cover 43. Since the main body-side abutting portion 67 is situated near the imaginary line L connecting the platen drive shaft 45 (platen roller 120) and the take-up drive shaft 47 (take-up core 116), the rotational forces (moments of rotation) originating from the drive forces of the platen drive shaft 45 and the take-up drive shaft 47 have almost no vector components in directions of canceling each other and therefore form a superimposed force (combined force).

Therefore, even when the rotational forces (moments of rotation) of the platen drive shaft 45 and the take-up drive shaft 47 act on the tape cartridge 100, the main body-side abutting portion 67 and the cartridge-side abutting portion 166 abut against each other with the above superimposed force and therefore the misalignment of the tape cartridge 100 is restrained. Thus, degradation in the print quality due to the misalignment of the tape cartridge 100 can be prevented.

The invention claimed is:

1. A tape printing device comprising:

a cartridge loading section in which a tape cartridge is loaded in an unloadable manner; and a plurality of push switches provided in the cartridge loading section and configured to detect the loaded tape cartridge;

wherein each push switch included in the plurality of push switches has a stem which is energized in a protruding direction by a built-in spring, the stem of each push switch included in the plurality of push switches, in an actuated state, energizes the loaded tape cartridge in a direction intersecting with a loading direction, and the stem of a first push switch included in the plurality of push switches protrudes in a first protruding direction and the stem of a second push switch included in the plurality of push switches protrudes in a second protruding direction that intersects the first protruding direction.

2. The tape printing device according to claim 1, wherein the cartridge loading section includes a loading base portion and a loading peripheral wall portion surrounding the loading base portion, and each push switch included in the plurality of push switches is arranged on the loading peripheral wall portion, and the stem of each push switch included in the plurality of push switches energizes an outer circumferential surface of the tape cartridge facing the loading peripheral wall portion.

3. The tape printing device according to claim 2, wherein the tape cartridge has a plurality of sections to be detected on the outer circumferential surface, and a push switch included in the plurality of push switches is provided for each of the plurality of sections to be detected.

4. The tape printing device according to claim 3, wherein each section included in the plurality of sections to be detected is arranged in a dispersed manner in a circumferential direction on the outer circumferential surface of the tape cartridge, and each push switch included in the plurality of push switches is arranged in a dispersed manner in a circumferential direction of the loading peripheral wall portion at a position of a corresponding one of the plurality of sections to be detected.

5. The tape printing device according to claim 3, wherein a plurality of types of the tape cartridges with different thicknesses in the loading direction is loadable in the cartridge loading section, and the plurality of sections to be detected in the plurality of types of the tape cartridges have different lengths from a distal end in the loading direction, corresponding to the thicknesses, and the plurality of push switches is arranged in such a way as to have different distances from the loading base portion toward a direction opposite to the loading direction, corresponding to the plurality of sections to be detected in the plurality of types of the tape cartridges.

6. The tape printing device according to claim 5, wherein, of the plurality of push switches, the push switch with a shortest distance from a print head provided in the cartridge loading section is in an actuated state no matter which of the plurality of types of the tape cartridges is loaded.

7. A tape printing device comprising:

a cartridge loading section in which a tape cartridge is loaded in an unloadable manner; and a push switch which is provided in the cartridge loading section and detects the loaded tape cartridge;

wherein the push switch has a stem which is energized in a protruding direction by a built-in spring, the stem, in an actuated state, energizes the loaded tape cartridge in a direction intersecting with a loading direction, the tape cartridge has an insertion opening in which a head cover covering a print head provided in the cartridge loading section is inserted, and the push switch is provided at an edge part of the head cover, and the stem energizes a corner part of the insertion opening corresponding to the edge part.

8. The tape printing device according to claim 7, comprising a main body abutting portion provided in a protruding manner on the head cover, corresponding to a cartridge-side abutting portion provided in a recessed manner at the corner part of the insertion opening, wherein the main body abutting portion is provided on the head cover in a movable manner in a direction of fitting with the cartridge-side abutting portion, and the stem energizes the cartridge-side abutting portion via the main body abutting portion.

9. The tape printing device according to claim 8, wherein the main body cutting portion is supported on the head cover in such a way as to be able to swivel via a swivel shaft.

10. The tape printing device according to claim 8, further comprising:

a first output portion which is provided in the cartridge loading section and outputs a forward rotational force to feed the print tape of the loaded tape cartridge; and a second output portion which is provided in the cartridge loading section and outputs a reverse rotational force to feed the ink ribbon of the loaded tape cartridge;

wherein the main body abutting portion is arranged on or near an imaginary line connecting the first output portion and the second output portion.

11. The tape printing device according to claim 10, wherein the first output portion has a platen drive shaft which rotationally drives a platen roller of the tape cartridge feeding the print tape, and the second output portion has a take-up drive shaft which rotationally drives a take-up core of the tape cartridge taking up the ink ribbon.

12. A tape printing system comprising:

the tape printing device according to claim 1; and the tape cartridge loaded in the cartridge loading section in an unloadable manner.

* * * * *